US008754627B1

(12) United States Patent
Le

(10) Patent No.: US 8,754,627 B1
(45) Date of Patent: Jun. 17, 2014

(54) MULTI-MODE POWER POINT TRACKING

(75) Inventor: Triet Tu Le, Portland, OR (US)

(73) Assignee: SolarBridge Technologies, Inc., Austin, TX (US)

( * ) Notice: Subject to any disclaimer, the term of this patent is extended or adjusted under 35 U.S.C. 154(b) by 311 days.

(21) Appl. No.: 13/091,026

(22) Filed: Apr. 20, 2011

Related U.S. Application Data

(60) Provisional application No. 61/326,201, filed on Apr. 20, 2010.

(51) Int. Cl.
*G05F 1/67* (2006.01)

(52) U.S. Cl.
USPC ..... 323/299; 323/906; 363/131

(58) Field of Classification Search
USPC ..... 323/299, 906; 363/131
See application file for complete search history.

(56) References Cited

U.S. PATENT DOCUMENTS 4,899,269 A * 2/1990 Rouzies ..... 363/41
2006/0164065 A1* 7/2006 Hoouk et al. ..... 324/76.17

OTHER PUBLICATIONS

Bangyin Liu, Shanxu Duan, Fei Liu, Pengwei Xu; Analysis and Improvement of Maximum Power Point Tracking Algorithm Based on Incremental Conductance Method for Photovoltaic Array; IEEE Power Electronics and Drive Systems 7th International Conference, 2007, pp. 637-641.*

Zainudin, H. N. et al., "Comparison Study of Maximum Power Point Tracker Techniques for PV Systems," Proceedings of the 14th International Middle East power Systems Conference, Cairo University, Egypt, Dec. 19-21, 2010, 6 pages.

Lee, J. H. et al., "Advanced Incremental Conductance MPPT Algorithm with a Variable Step Size," EPE-PEMC, Portoroz, Solvenia, 2006, 5 pages.

Calavia, M. et al., "Comparison of MPPT Strategies for Solar Modules," International Conference on Renewable Energies and Power Quality, Granada, Spain, Mar. 23-25, 2010, 6 pages.

Kouta, J. et al., "Improving the Incremental Conductance Control Method of a Solar Energy Conversion System," International Conference on Renewal Energies and Power Quality, Las Palmas, Spain, Mar. 12-14, 2008, 4 pages.

* cited by examiner

*Primary Examiner* — Harry Behm
(74) *Attorney, Agent, or Firm* — Grasso PLLC; Fred Grasso

(57) ABSTRACT

A method for tracking a power point for a power source includes calculating voltage and current errors for the power source, selecting either the voltage error or the current error, and controlling the power converter with a first control loop in response to the selected error. The voltage and current errors may be calculated in response to voltage and current targets, respectively, which may be calculated by a second control loop that implements an MPPT algorithm. The second control loop may calculate the voltage and current targets in response to which error the first control loop selects. A method for tracking a power point for a power source having multiple local power maxima includes measuring the individual voltage across one or more series-connected power elements in the power source, and controlling the power in response to the overall voltage and current as well as the individual voltage.

19 Claims, 8 Drawing Sheets

MULTI-MODE POWER POINT TRACKING

CROSS-REFERENCE TO RELATED APPLICATIONS

This application claims priority from U.S. Provisional Patent Application Ser. No. 61/326,201 titled Inverter Input Stage Control filed Apr. 20, 2010.

BACKGROUND

FIG. 1 illustrates the current and power characteristics of a photovoltaic (PV) panel as a function of output voltage. The upper curve illustrates how the output current changes as the output voltage increases. Beginning at the far left side of the curve where the voltage is zero (short-circuit voltage) the output current remains relatively constant until the voltage reaches a point at which the current begins to curve downward. The current then falls off sharply and reaches zero at the open-circuit voltage $V_{OC}$.

The lower curve is obtained by multiplying the corresponding current by the operating voltage to obtain the effective power at every voltage level. Beginning at the far left side of the curve where the voltage is zero, the power is also zero but increases until reaching a maximum value at $V_{MPP}$. The power then decreases until reaching zero where the current falls to zero.

Referring to the top curve, the region to the left of the maximum power point ($V_{MPP}$) is generally referred to as the current source region because output of the PV panel is generally a constant current. The region to the right of the maximum power point is generally referred to as the voltage source region because output of the PV panel is a relatively constant voltage.

Control of power converter and algorithms for maximum power point tracking (MPPT) often struggle to accommodate the transition between operating in the current source region and the voltage source region because transitioning between the two regions may change the dynamics of power converter control and the MPPT algorithm.

DETAILED DESCRIPTION

Concurrent Voltage and Current Control

Figure 2:
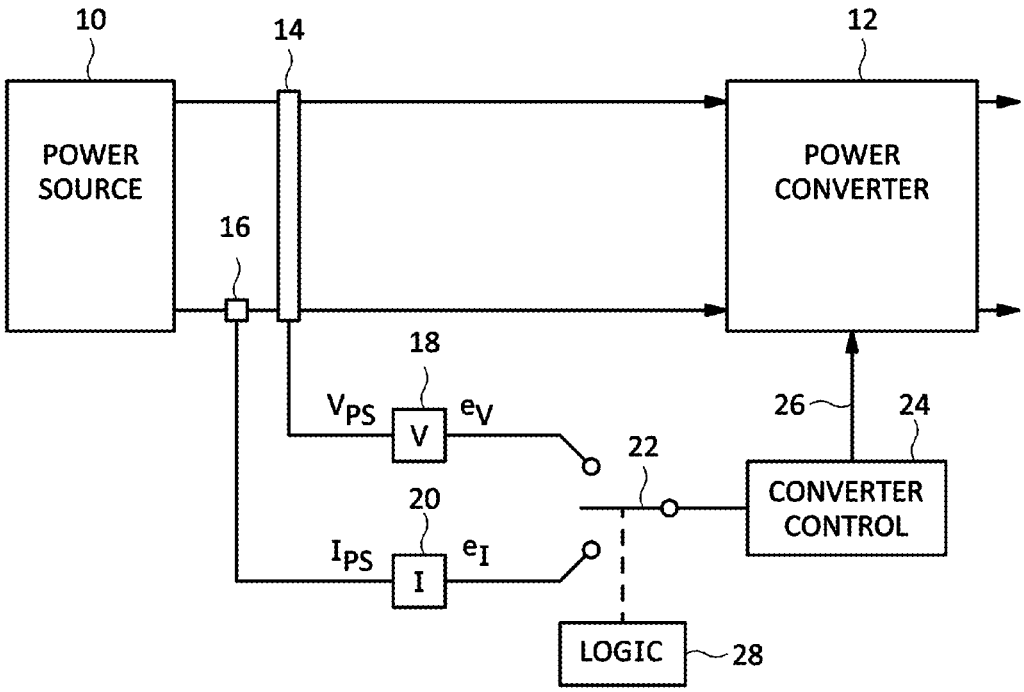
FIG. 2 illustrates an embodiment of a power point tracking system according to some inventive principles of this patent disclosure.

FIG. 2 illustrates an embodiment of a power point tracking system according to some inventive principles of this patent disclosure. The embodiment of FIG. 2 includes a power source 10 coupled to a power converter 12. Sensors 14 and 16 provide voltage and current feedback to voltage and current error generators 18 and 20, respectively. A selector 22 selects the output from one of the error generators in response to selection logic 28 and applies it to a converter controller 24, which generates one or more control signals 26 that control the operation of the converter 12, thereby completing a control loop.

The voltage and current error generators 18 and 20 operate continuously so that the voltage error $e_V$ and current error $e_I$ are both calculated concurrently whenever the control loop is running, regardless of which error the selector 22 is routing to the converter controller 24.

The embodiment of FIG. 2 may enable the implementation of numerous different types of power point tracking systems that provide improved performance and reliability, reduced manufacturing cost and/or other benefits and advantages. For example, the embodiment of FIG. 2 may be used to implement a flexible control system in which the power converter can operate with input voltage control, input current control, or both modes depending on operating conditions. Because the voltage and current errors are generated concurrently, the system may be able to switch rapidly between modes.

Figure 1:
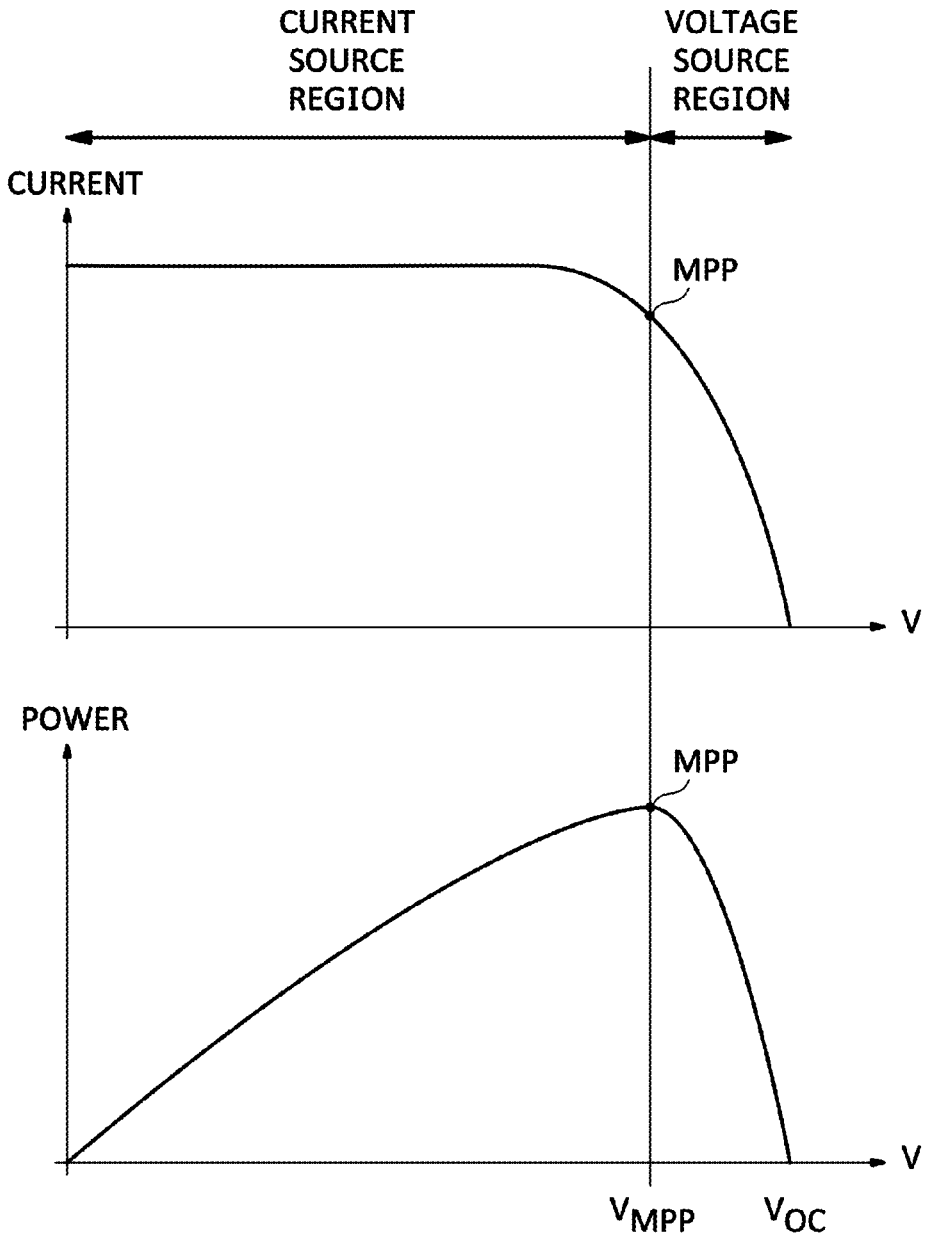
FIG. 1 illustrates the current and power characteristics of a photovoltaic panel as a function of output voltage.

Switching between modes may also help the control system cope with the different dynamics in the current source region and the voltage source region of the V-I characteristic of a PV panel or other power source. For example, referring to the V-I characteristic shown in FIG. 1, in the current source region, it may be difficult to operate in current control mode because even a small change in the current setting may produce a very large change in the output voltage. Likewise, in the voltage source region, a small change in the voltage level may produce a large swing in the current level. Therefore, it may be beneficial to operate the embodiment of FIG. 2 in voltage control mode while in the current source region and to operate in current control mode while in the voltage source region. The inventive principles may enable the system to switch smoothly and rapidly between these modes, thereby improving the system dynamics.

Moreover, because the voltage and current errors are generated concurrently, they may be used to implement control systems that take advantage of the distinction between the current source region and the voltage source region of the output characteristic of a PV power source. That is, rather than coping with, or adapting to, transitions between the current source and voltage source regions, the inventive principles may actually make use of the existence of these distinct regions to help determine the maximum power point for the PV power source, which typically occurs at the transition between these two regions.

The embodiment of FIG. 2 may also be used to implement a fast, tightly integrated control loop that may provide improved stability over a wider operating range. Moreover, this fast control loop may be used as an inner control loop that interacts with a slower, outer control loop as described below to provide a higher level of functionality. In fact, an outer control loop may be configured to observe the operation of the inner control loop of FIG. 2 to determine the region in which the power source is operating and use the resulting observation to alter its operation as described below.

If the outer control loop implements a maximum power point tracking (MPPT) algorithm, the ability of the inner control loop to operate in different modes may reduce the complexity and/or improve the performance of the MPPT algorithm. In some embodiments, one of the control modes may be implemented as a master mode, with the other mode implemented as a slave mode. In other embodiments, both modes can be configured to control the power converter independently. In still other embodiments, one mode may be set as a dominant control loop that controls the system during a majority of the time, while the other mode may be triggered by events such as, for example, a crash prevention event.

Crashing is a potential problem with power conversion systems in which the power source may experience a rapid loss in power generating capacity. One example is solar power systems in which photovoltaic (PV) panels are used to generate electric power that is fed into a local utility grid. These systems typically include an array of PV panels, often with local power optimizer modules, that generate DC electricity. A centralized inverter is used to convert the DC power from the PV panels to AC power for the grid. The central inverter and/or local power optimizers may implement MPPT algorithms to maximize the amount of power harvested from the PV panels.

If one or more of the PV panels (or strings or cells within the panels) become shaded from passing clouds, swaying trees, etc., the output voltage of the panel may decrease to a point where the power electronics in the local power optimizers and/or central inerter can no longer function properly and the panel and its associated power electronics must be shut down. This is referred to as crashing, and depending on the configuration of the system, this may lead to a ripple effect where the entire array or generating installation must be shut down and restarted. Therefore, MPPT algorithms often include crash prevention functionality that monitors the voltage of each PV panel and adjusts the operation of the optimizer in an effort to prevent the input or output voltage of the PV panel from falling below a minimum level or voltage floor. However, this additional crash prevention functionality complicates and slows down the MPPT algorithm.

The embodiment of FIG. 2 may enable the crash prevention functionality to be offloaded from the MPPT algorithm. Specifically, as mentioned above, the embodiment of FIG. 2 may be used to implement a fast, tightly integrated control loop that can be used as an inner control loop that interacts with a slower, outer control loop. If the MPPT algorithm is implemented in the outer control loop, the crash prevention functionality may be moved to the inner control loop because it continuously processes the voltage error whenever the inner control loop is running. This may provide improved crash protection because the inner control loop may be configured to run faster than a typical MPPT algorithm. Moreover, offloading the crash prevention functionality to the inner control loop reduces the computational burden on the MPPT algorithm, thereby enabling the MPPT algorithm to be simpler, faster, more responsive, etc., or alternatively, enabling the MPPT algorithm to take on additional high-level functionality.

Although the inventive principles are not limited to any particular implementation details, they may be particularly useful in the context of power systems in which the power source 10 is implemented with one or more PV panels, fuel cells, storage batteries, wind turbines, or other sources having output characteristics that benefit from tracking the power point to maintain operation at a maximum power point (MPP). Thus, the power converter 12 may be implemented with one or more DC/DC, DC/AC or AC/DC converters and may include one or more stages such as buck converters, boost converters, push-pull stages, rectifiers, inverters, etc., arranged as pre-regulators, input stages, main stages, output stages, etc. The converter controller 24 may therefore be implemented with any type of control scheme suitable for the corresponding converter, and may implement, for example, pulse width modulation (PWM), pulse frequency modulation (PFM), hysteretic control, resonant switching control, etc.

The voltage and current sensors 14 and 16 may be implemented with any suitable techniques including simple galvanic sense connections, voltage transformers, current transformers, shunt resistors, Hall Effect sensors, etc.

The voltage and current error generators 18 and 20, selector 22, selection logic 28, and converter controller 24 may be implemented with analog or digital hardware, software, firmware or any suitable combination thereof. In some example embodiments, the outputs from the voltage and current sensors 14 and 16 may be digitized immediately and provided to one or more microcontrollers or digital signal processors (DSPs) which may be used to implement an entirely digital implementation of the control loop.

Figure 3:
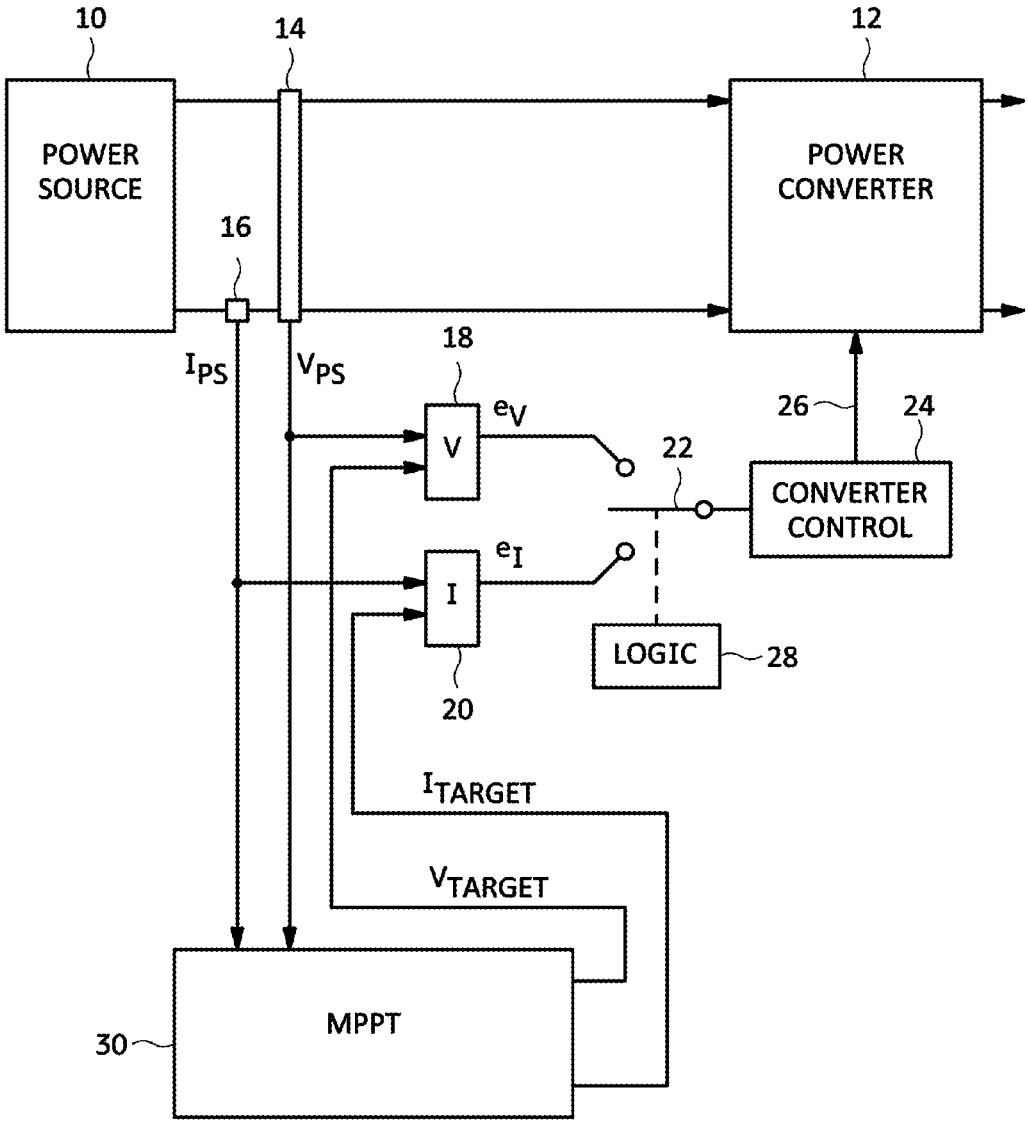
FIG. 3 illustrates another embodiment of a power point tracking system according to some inventive principles of this patent disclosure.

FIG. 3 illustrates another embodiment of a power point tracking system according to some inventive principles of this patent disclosure. The embodiment of FIG. 3 includes components similar to those of FIG. 2, but further includes MPPT functionality 30 configured as a second, outer control loop. The MPPT functionality receives the power source voltage and current signals $V_{PS}$ and $I_{PS}$, respectively, and uses them to generate voltage and current targets $V_{TARGET}$ and $I_{TARGET}$, which are used by the voltage and current error generators 18 and 20 to generate the voltage error $e_V$ and current error $e_I$. The MPPT functionality may further make use of information from the selection logic 28, or the voltage error $e_V$ and current error $e_I$ outputs from the error generators 18 and 20.

The MPPT functionality 30 may implement any suitable MPPT algorithm including perturb and observe (P&O), incremental inductance (IC), etc., although some additional novel algorithms according to the inventive principles of this patent disclosure are presented below. The MPPT functionality 30 may be implemented with analog or digital hardware, software, firmware or any suitable combination thereof.

Figure 4:
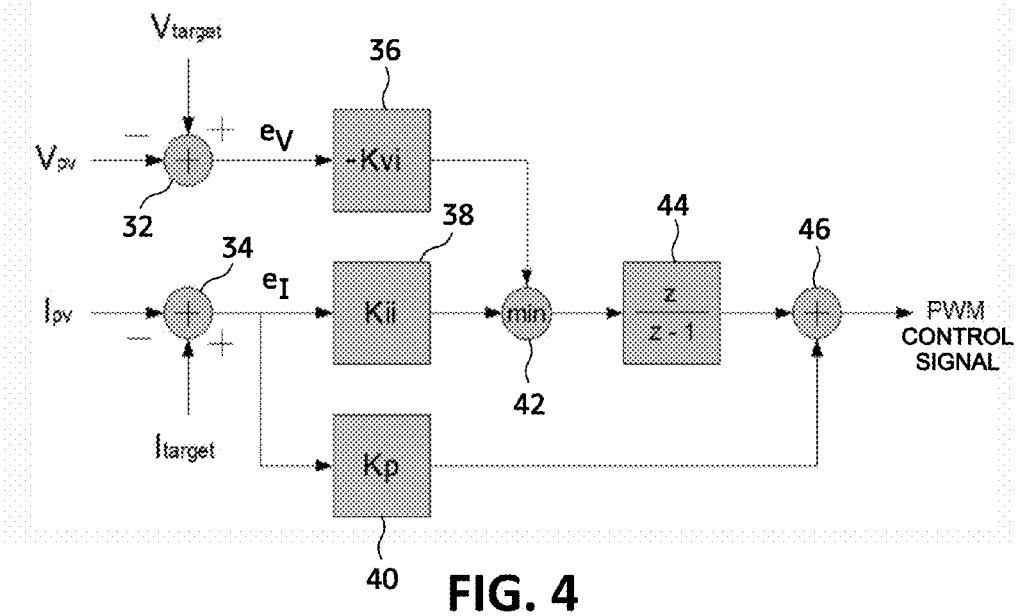
FIG. 4 illustrates an example embodiment of a power point tracking loop according to some inventive principles of this patent disclosure.

FIG. 4 illustrates an example embodiment of a power point tracking loop according to some inventive principles of this patent disclosure. The example of FIG. 4 may be used, for example, to implement the system of FIG. 2 and/or the inner control loop in the system of FIG. 3. The embodiment of FIG. 4 will be illustrated in the context of a system having a PV panel as the power source and a DC/AC inverter having an input stage with a PWM control input as the power converter, but the inventive principles are not limited to these details.

The embodiment of FIG. 4 is implemented as a proportional-integral (PI) control loop and includes a voltage error generator 32 that calculates a voltage error $e_V$ in response to the output voltage $V_{PV}$ of the PV panel and a voltage target $V_{TARGET}$. A current error generator 34 calculates a current error $e_I$ in response to the output current $I_{PV}$ of the PV panel and a current target $I_{TARGET}$. A first multiplier 36 multiplies the voltage error by an integral loop gain constant −Kvi, while a second multiplier 38 multiplies the current error by an integral loop gain constant Kii. An optional third multiplier 40 multiplies the current error by a proportional feed forward gain constant Kp.

A minimum value selector 42 selects the output from either the first or second multiplier and applies it to an integrating element 44. Thus, the minimum value selector 42 places the control loop in either a predominantly voltage mode of operation or a predominantly current mode of operation depending on whether it selects the voltage error path or current error path.

A summing element 46 adds the outputs from the integrating element 44 and the third multiplier to generate the output which is used to generate a PWM control signal for controlling the input stage of the inverter. The use of the proportional term $K_P$ reduces the loop response time when operating in current control mode, and this term may be left out when operating in voltage control mode.

Figure 5:
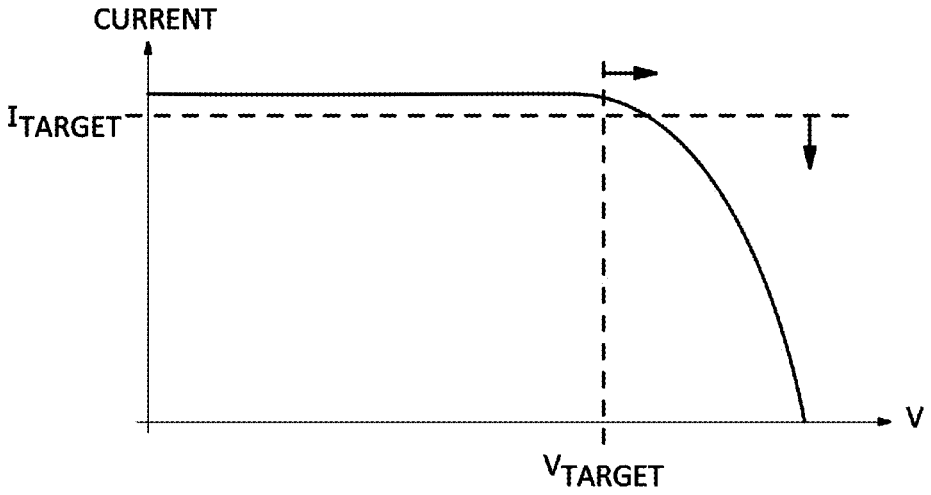
FIG. 5 illustrates the operation of the voltage and current targets in the embodiment of FIG. 4.

With the system of FIG. 4, the target voltage $V_{TARGET}$ may be used to implement a voltage floor, while the current target $I_{TARGET}$ may be used to implement a current limit. This is illustrated in FIG. 5 where the controller tracks the current when the input current $I_{PV}$ is above the current limit $I_{TARGET}$, and track the voltage when the input voltage $V_{PV}$ is below the voltage floor $V_{TARGET}$. If the voltage is above the voltage floor, and the current is below the current limit, the minimum value selector 42 places the control loop in either voltage mode or current mode by selecting the signal path that yields the smaller error. Thus, the loop can switch smoothly and seamlessly between voltage mode and current mode operation because the minimum integral error term is selected prior to integration so the smaller of the two integral terms dominates the other. That is, the selector chooses the mode that has the smallest effect on the operating point. This may enable the use of a simpler MPPT algorithm as described below.

The minimum value selector 42 selects the actual minimum value of the signed error inputs, i.e., it does not determine the absolute value of either of the inputs.

MPPT Algorithms

Figure 6:
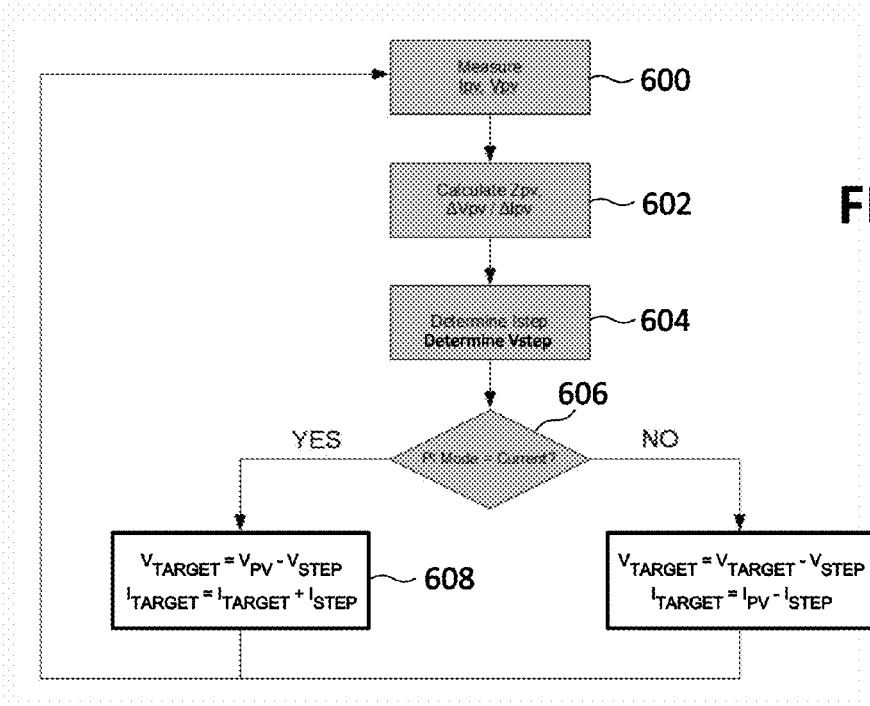
FIG. 6 illustrates an embodiment of an impedance based MPPT algorithm according to some inventive principles of this patent disclosure.

FIG. 6 illustrates an embodiment of an MPPT algorithm according to some inventive principles of this patent disclosure. The embodiment of FIG. 6 may be used, for example, to implement the MPPT functionality 30 shown in FIG. 3 with the faster, inner control loop running concurrently. It is described in the context of a PV panel coupled to an inverter, but the inventive principles are not limited to these particular details.

The control loop of FIG. 6 implements an impedance-based MPPT algorithm and begins at 600 by measuring the panel voltage (Vpv) and current (Ipv). The panel voltage and current may have analog filtering, digital filtering, or some combination of both. At 602, the panel impedance (Zpv) and incremental conductance (ΔVpv/ΔIpv) are calculated based on the measured values of the panel voltage and current. At 604, the current step (Istep) and voltage step (Vstep) are calculated using an algorithm such as the one shown in Appendix A.

At 606, the algorithm checks to see whether the inner control loop is running in current-control or voltage-control mode, that is, whether current-mode or voltage-mode is dominant. If current-mode control is dominant, then the target current (current limit) $I_{TARGET}$ is increased by Istep, and the target voltage (voltage floor) $V_{TARGET}$ is recalculated by subtracting Vstep from $V_{PV}$ at 608. If voltage-mode control is dominant, then $V_{TARGET}$ is decreased by Vstep, and $I_{TARGET}$ is recalculated by subtracting Istep from $I_{PV}$ at 610. The criteria for determining the dominant mode of control may, for example, be a comparison of $V_{TARGET}$ to $V_{PV}$ or a comparison of $I_{TARGET}$ to $I_{PV}$.

The new values of $I_{TARGET}$ and $V_{TARGET}$ are then applied to the inner control loop of FIG. 4, and the method loops back around to measure the panel voltage and current again at 600.

As an initial condition, the method can be initiated with either or both of the target values set to zero. For example, by setting the target current to zero, the operating point may begin at the open circuit voltage, then climb up the V-I curve to the MPPT in a steady, controlled manner. The asymmetry between the calculations in 608 and 610 may facilitate the implementation of a system in which the current increases slowly at start-up but is able to decrease rapidly for power limiting purposes if the system needs to be shut off quickly.

Thus, the method illustrated in FIG. 6 enables the implementation of an MPPT algorithm in which the power converter is controlled in response to both a voltage step and a current step that are calculated concurrently in an outer control loop, then used to calculate voltage and current errors concurrently in an inner control loop, only one of which may be selected for use at a time. This may simplify the MPPT algorithm and improve the system dynamics. Moreover, the method illustrated in FIG. 6 may be relatively insensitive to quantization errors in any A/D converters that are used to sample the panel voltage and current.

Figure 7:
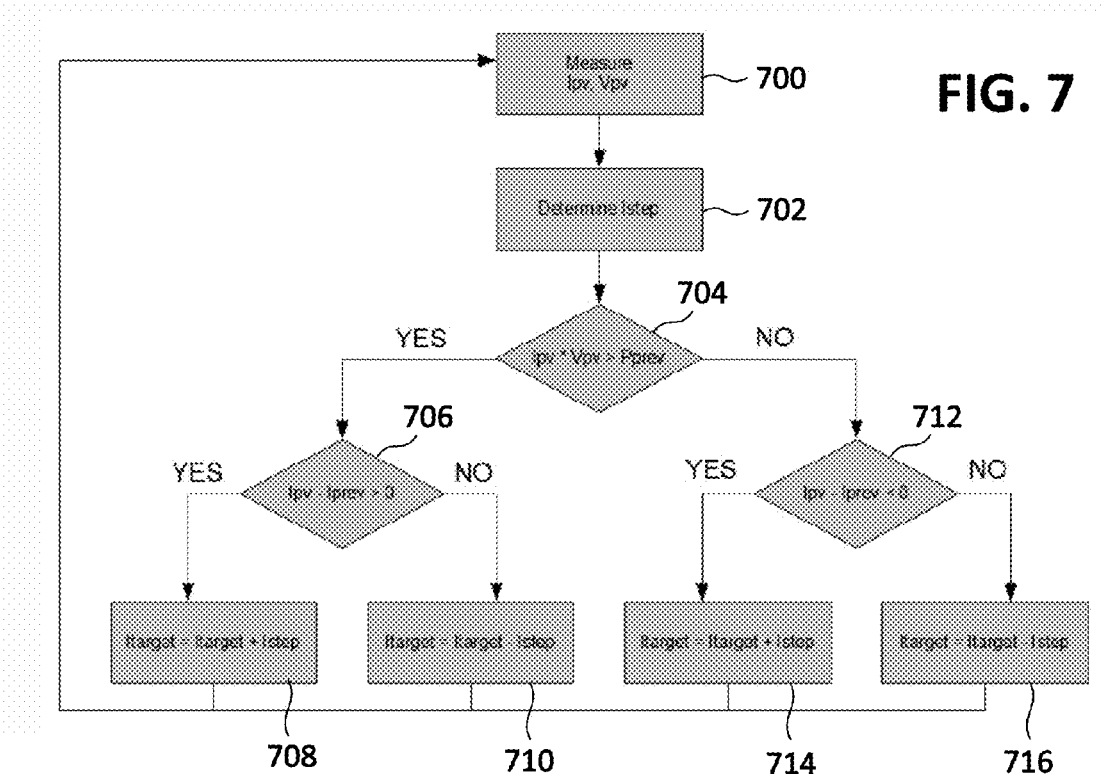
FIG. 7 illustrates an embodiment of a power-based hill climbing MPPT algorithm according to some inventive principles of this patent disclosure.

FIG. 7 illustrates another embodiment of another MPPT algorithm according to some inventive principles of this patent disclosure. The embodiment of FIG. 7 may also be used, for example, to implement the MPPT functionality 30 shown in FIG. 3 with the faster, inner control loop running concurrently. It is also described in the context of a PV panel coupled to an inverter, but the inventive principles are not limited to these particular details.

The control loop of FIG. 7 implements a power-based hill climbing MPPT algorithm and begins at 700 by measuring the panel voltage (Vpv) and current (Ipv). At 702, the current step (Istep) is calculated using an algorithm such as the one shown in Appendix A. At 704, the algorithm determines the direction in which the power point should move by comparing the current power (Ipv*Vpv) to the previous power $P_{PREV}$. If the power is increasing (YES response at 704), the algorithm is moving the power point in the correct direction and should continue moving in that direction. At 706, the algorithm determines what that direction is, and at 708 or 710, the target current $I_{TARGET}$ is incremented or decremented to keep it moving in the same direction. If the power is decreasing (NO response at 704), the algorithm is moving the power point in the wrong direction and should begin moving it in the opposite direction. At 712, the algorithm determines what the previous direction was, and at 714 or 716, the target current $I_{TARGET}$ is incremented or decremented to move it in the opposite direction.

The new value of $I_{TARGET}$ is then applied to the inner control loop of FIG. 4, and the method loops back around to measure the panel voltage and current again at 700.

In this embodiment, the voltage step (Vstep) is not used dynamically as part of the MPPT algorithm, but if the algorithm is implemented with an inner control loop such as that shown in FIG. 4, a static value of $V_{TARGET}$ may be applied to the error generator 32 to provide a voltage catch (crash prevention).

Figure 8:
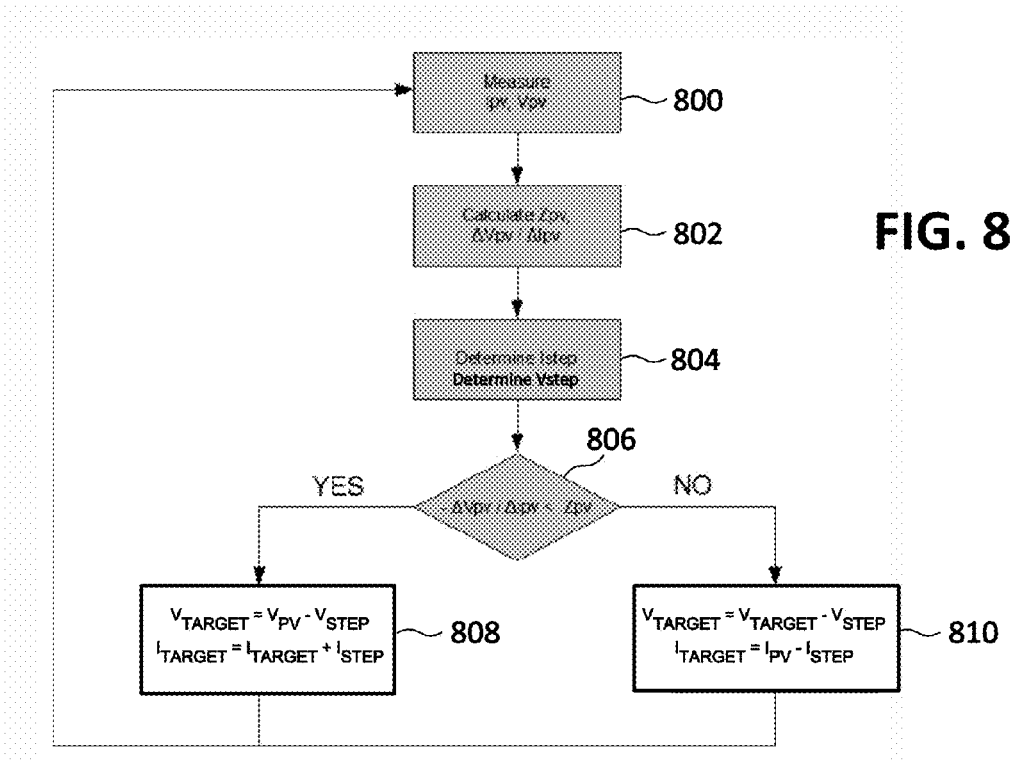
FIG. 8 illustrates an embodiment of an incremental conductance based MPPT algorithm according to some inventive principles of this patent disclosure.

FIG. 8 illustrates another embodiment of an MPPT algorithm according to some inventive principles of this patent disclosure. The embodiment of FIG. 8 may also be used, for example, to implement the MPPT functionality 30 shown in FIG. 3 with the faster, inner control loop running concurrently. It is described in the context of a PV panel coupled to an inverter, but the inventive principles are not limited to these particular details.

The control loop of FIG. 8 implements an incremental conductance based MPPT algorithm and begins at 800 by measuring the panel voltage (Vpv) and current (Ipv). At 802, the panel impedance (Zpv) and incremental conductance (ΔVpv/ΔIpv) are calculated based on the measured values of the panel voltage and current. At 804, the current step (Istep) and voltage step (Vstep) are calculated using an algorithm such as the one shown in Appendix A.

At 806, the algorithm compares the incremental conductance to the panel impedance. If the incremental conductance is less than the panel impedance, then the target current (current limit) $I_{TARGET}$ is increased by Istep, and the target voltage (voltage floor) $V_{TARGET}$ is recalculated by subtracting Vstep from $V_{PV}$ at 808. If the incremental conductance is greater than the panel impedance, then $V_{TARGET}$ is decreased by Vstep, and $I_{TARGET}$ is recalculated by subtracting Istep from $I_{PV}$ at 810.

The new values of $I_{TARGET}$ and $V_{TARGET}$ are then applied to the inner control loop of FIG. 4, and the method loops back around to measure the panel voltage and current again at 800.

Although the embodiments of FIGS. 6-8 are not limited to any particular implementation details, they may be particularly useful for use as relatively slow, outer MPPT algorithms that may be used in conjunction with a relatively fast, inner control loop such as those shown in FIGS. 3 and 4. In such an implementation, the inner loop may operate at, for example, about 100 KHz, whereas the outer loop may operate at a few KHz.

Multi-Hill MPPT

Some additional inventive principles of this patent disclosure relate to power point tracking for a power source that includes two or more series-connected power elements. For example, a power source such as a PV panel may include numerous PV cells, or strings of PV cells, connected in series. As another example, a storage battery typically includes several series-connected cells. When one or more of the series-connected power elements experiences a power reduction event, such as shading of one of the strings in a PV panel, it may cause the overall power characteristic of the panel to develop multiple local maxima (or "hills"), some of which may be lower than the others.

Figure 9:
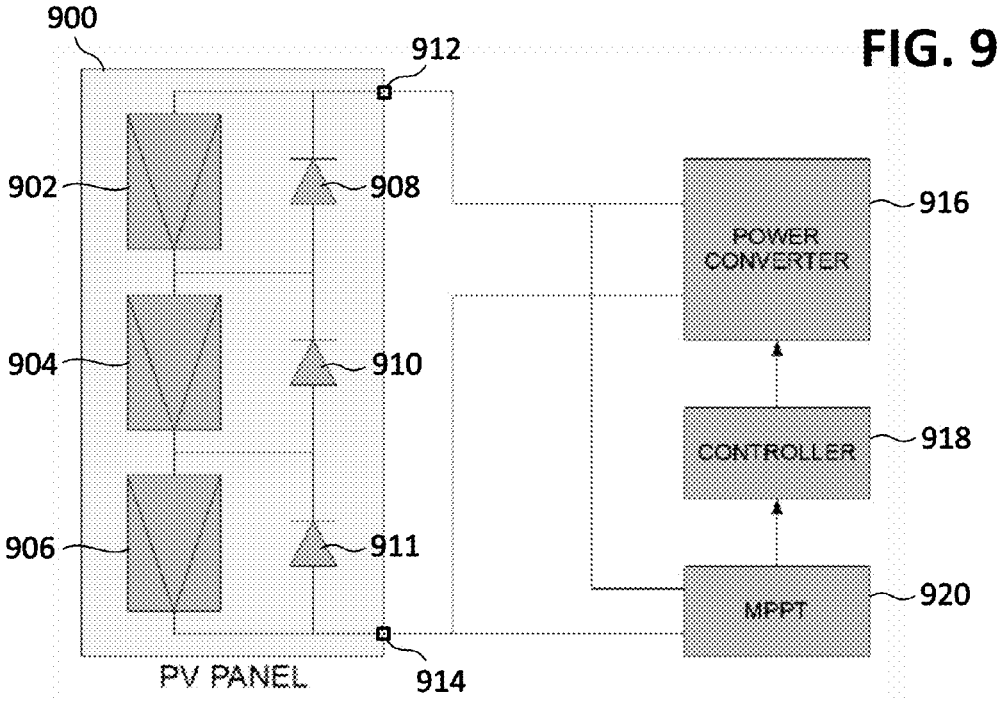
FIG. 9 illustrates a conventional PV power system having a PV panel with series-connected strings.

FIG. 9 illustrates a conventional PV power system having a PV panel 900 with three matched, series-connected strings 902, 904, 906 and three bypass diodes 908, 910 and 911. The only connections available outside of the panel are the two main power terminals 912 and 914. The output power from the panel 900 is applied to a power converter 916 which is controlled by a controller 918 and MPPT algorithm 920.

Figure 10:
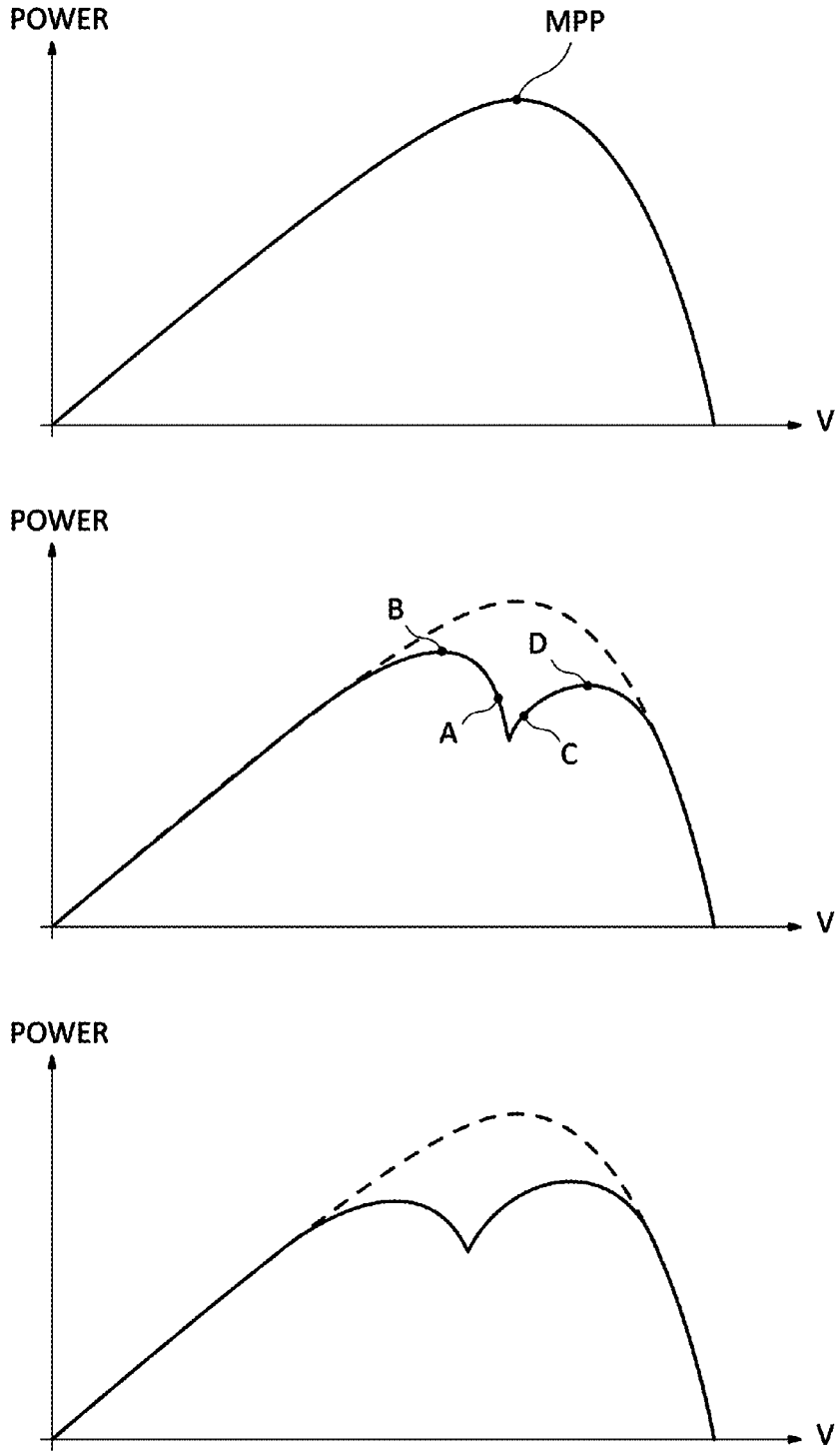
FIG. 10 illustrates three different exemplary power curves for the panel of FIG. 9.

FIG. 10 illustrates three different exemplary power curves for the panel of FIG. 9. In the upper curve, all three strings are receiving equal radiation. In the middle and lower curves, various ones of the strings are subjected to shading. In the upper curve with no shading, the MPP can be reached monotonically from any point on the curve with a conventional MPPT algorithm that simply determines the direction of slope at the starting point and move upward until reaching the maximum. In the middle curve, however, the success of such a conventional algorithm depends on the starting point. If it begins at point A, it will successfully reach the highest power peak at point B. If, however, it begins at point C, it will only reach the lower, local peak at point D. The same problem exists with lower curve in FIG. 10.

One solution to the multi-hill problem illustrated with the middle and lower curves of FIG. 9 is to sweep the operating point throughout the entire operating voltage range to search for every peak, then select the highest one. Such a technique, however, sacrifices significant time and power harvesting because of the extensive range through which the voltage must be swept.

When a power source having multiple series-connected power elements is fabricated in an assembly that does not provide access to the nodes between the individual power elements, there may be no alternative to sweeping the entire operating range. In some situations, however, the nodes may be accessible, or may be made accessible with relatively little effort. For example, some PV panels and/or modules are manufactured with nodes that are reasonably accessible to facilitate connection of the bypass diodes which may need to be mounted in a relatively accessible location for replacement or cooling purposes. In such a situation, voltage sensing connections can be made to the nodes between the series-connected strings in the panel, thereby facilitating power point tracking algorithms according to some inventive principles of this patent disclosure.

Figure 11:
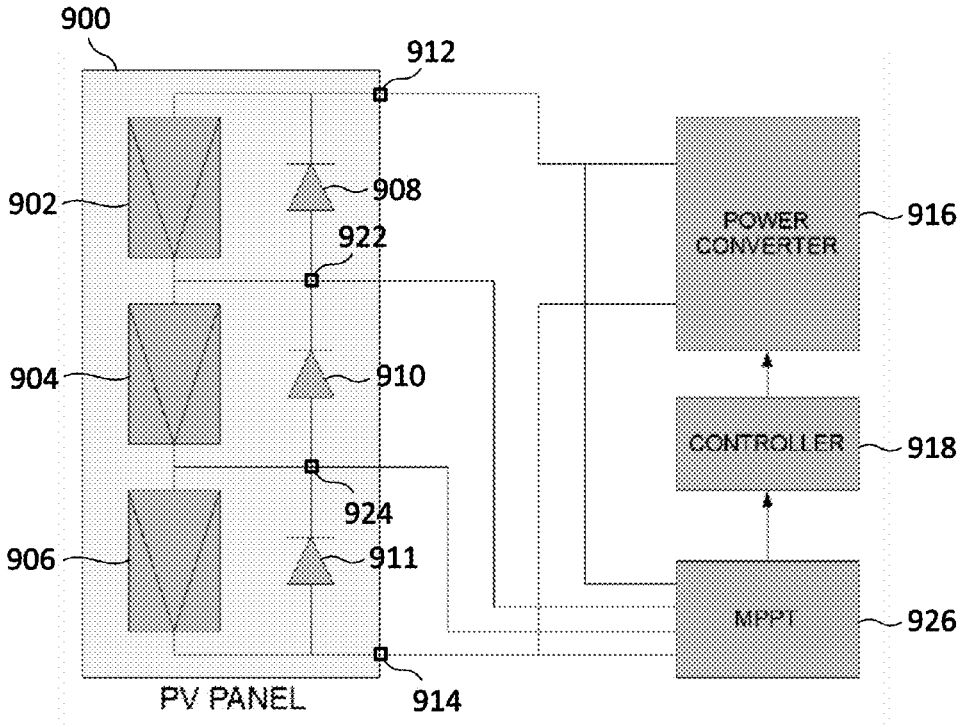
FIG. 11 illustrates an embodiment of a PV power system having multi-hill power point tracking capability according to some inventive principles of this patent disclosure.

FIG. 11 illustrates an embodiment of a PV power system having multi-hill power point tracking capability according to some inventive principles of this patent disclosure. The embodiment of FIG. 11 includes many of the elements of FIG. 9, but the relative accessibility of nodes 922 and 924 enables two additional voltage sense leads to be connected to the MPPT functionality 926.

With the additional sense leads available, the MPPT algorithm may be modified to not only measure the output voltage and output current of the overall power source, but to measure the voltage across one of the series-connected power elements. The power converter may then be controlled in response to the output voltage and output current of the power source, and the voltage across the one series-connected power element. Preferably, the voltage across all of the series-connected power elements may be measured, and the power converter may be controlled in response to the voltage across all of the series-connected power elements.

The MPPT algorithm of FIG. 11 may begin by measuring the voltage across each of the strings and comparing them to determine of any of the strings is operating at a significantly lower voltage than the other strings. A reduced operating voltage may indicate that the string is shaded or has aged in a more pronounced manner than the other strings. Regardless of the cause, the presence of the string having a reduced voltage may result in a multi-hill power characteristic. To accommodate such a characteristic, the MPPT algorithm may calculate a starting point where the local maximum is also the overall maximum power point. One example embodiment of a multi-hill MPPT algorithm according to some inventive principles of this patent disclosure is described in Appendix B.

The inventive principles of this patent disclosure have been described above with reference to some specific example embodiments, but these embodiments can be modified in arrangement and detail without departing from the inventive concepts. Such changes and modifications are considered to fall within the scope of the claims following the Appendices.

APPENDIX A

The following equations and algorithm may be used to calculate the current step (Istep) and voltage step (Vstep) for an MPPT algorithm.

$$Pratio = dP/(VdI), \quad a)$$

where dP=change in power, and dI=change in voltage This is the power ratio of the change in power over VdI, which is the maximum power change at open circuit voltage.

$$Istep=Pratio*Istepmax \quad b)$$

Istep max is the maximum allowable current step and is chosen based on power converter design.

$$Vstep=Istep*Vpv/Ipv*\text{Lean factor} \quad c)$$

Vpv/Ipv is panel impedance

Lean factor is 1.0 for perfect MPPT and can be any positive number to cause the power converter stage to lean left or right off of the maximum power point.

APPENDIX B

The following algorithm expressed in Matlab simulation terms may be used to determine the maximum power point for a power source having multiple strings and local power point maxima.

```
if Vpv(ii) > Vtarget(ii)                    %% Do normal MPPT for
                                            %% current ramp up
    Itarget (ii+1) = Itarget (ii) + Istep;
    Vtarget (ii+1) = Vpv (ii) – Vstep;
  elseif Vpv (ii) < Vtarget (ii)            %% Entering voltage
                                            %% control mode
    if maxv/Vpv (ii) > 1.111/3 &&           %% Shade detected, keep
enter == 0;                                 %% increasing the
                                            %% current
      Itarget (ii+1) = Itarget (ii) + Istep;
      Vtarget (ii+1) = Vpv (ii) – Vstep;
      enter = 1;                            %% enter multi-hill
                                            %% routine
      Venter = Vpv(ii);
    elseif maxv/Vpv (ii) > 1.111/3 &&       %% Something is shaded,
enter == 1                                  %% stay here until the
                                            %% shade is gone
      if Vpv (ii) > Venter*2/3              %% Operates toward the
                                            %% next hill by
                                            %% increasing current
        Itarget (ii+1) = Itarget (ii) + Istep;
        Vtarget (ii+1) = Vpv (ii) – Vstep;
        enter = 1;
      else                                  %% Other shoot the next
                                            %% hill, turning back
                                            %% by decreasing
                                            %% current
        Itarget (ii+1) = Ipv (ii) – Istep;
        Vtarget (ii+1) = Vtarget (ii) – Vstep;
        enter = 2;
      end
    else                                    %% Nothing is shaded,
                                            %% reduce current
      Itarget (ii+1) = Ipv (ii) – Istep;
      Vtarget (ii+1) = Vtarget (ii) – Vstep;
    end
  end
```

The invention claimed is:

1. A method for tracking a maximum power point for a power source coupled to a power converter, the method comprising:

measuring the output voltage and current of the power source;

determining a current step in response to the output voltage and current of the power source;

determining a voltage step in response to the output voltage and current of the power source; and controlling the power converter in response to both the voltage step and current step concurrently, wherein controlling the power converter in response to both the voltage step and current step concurrently includes selecting a voltage mode or current mode for controlling the power converter.

2. The method of claim 1 where the current step and voltage step are controlled in response to the selected mode.

3. The method of claim 1 where controlling the power converter in response to both the voltage step and current step concurrently includes:

determining an incremental conductance for the power source; and determining an impedance for the power source.

4. The method of claim 3 further comprising:

comparing the incremental conductance to the impedance; and determining the current step and the voltage step in response to the comparison.

5. The method of claim 1 further comprising calculating a starting point for a maximum power point algorithm in response to the voltage across each of a series-connected power elements.

6. The method of claim 1 further comprising:

estimating local maximums; and determining which of the local maximums is the global maximum for the power source.

7. The method of claim 6 further comprising validating the local and global maximums.

8. The method of claim 7 further comprising tracking the validated global maximum.

9. A method for tracking a maximum power point for a power source coupled to a power converter, the method comprising:

measuring the output voltage and current of the power source;

determining a current step in response to the output voltage and current of the power source;

determining a voltage step in response to the output voltage and current of the power source;

controlling the power converter in response to both the voltage step and current step concurrently;

calculating a voltage error for the power source;

calculating a current error for the power source concurrently with calculating the voltage error;

selecting the voltage error or the current error; and controlling the power converter with a first-control loop in response to the selected error.

10. The method of claim 9 where:

the voltage error is calculated in response to a voltage target;

the current error is calculated in response to a current target; and the method further comprises calculating the voltage target and the current target with a second control loop, the second control loop comprising:

the measuring of the output voltage and current of the power source;

the determining of a current step in response to the output voltage and current of the power source;

the determining of a voltage step in response to the output voltage and current of the power source; and the controlling of the power converter in response to both the voltage step and current step concurrently.

11. The method of claim 10 where the second control loop calculates the voltage and current targets in response to which error the first control loop selects.

12. The method of claim 10 where the second control loop implements a maximum power point tracking algorithm.

13. The method of claim 12 where the maximum power point tracking algorithm comprises an incremental conductance based algorithm.

14. The method of claim 10 where the second control loop comprises an impedance-based algorithm.

15. The method of claim 10 where the second control loop comprises a power-based hill climbing algorithm.

16. The method of claim 10 where:

the voltage target comprises a voltage floor; and the current target comprises a current limit.

17. The method of claim 9 where the first control loop is substantially faster than the second control loop.

18. The method of claim 9 where the first control loop integrates the selected error.

19. The method of claim 9 where the first control loop includes a proportional term for the current error.

* * * * *